US005709331A

United States Patent [19]

Lam et al.

[11] Patent Number: 5,709,331

[45] Date of Patent: Jan. 20, 1998

[54] METHOD FOR CALCULATING AND REGULATING THE ELONGATION OF A MOVING MATERIAL WEB, AND DEVICE FOR APPLYING THE METHOD

[75] Inventors: Theodorus Hendrikus Louis Maria Lam, Boven-Leeuwen; Theodoor Antonius Buchmeijer, Geldrop, both of Netherlands

[73] Assignee: Stork Contiweb B.V., Boxmeer, Netherlands

[21] Appl. No.: 629,091

[22] Filed: Apr. 8, 1996

[30] Foreign Application Priority Data

Apr. 12, 1995 [NL] Netherlands ..... 1000128

[51] Int. Cl.[6] ..... B65H 23/18; G06F 19/00

[52] U.S. Cl. ..... 226/4; 226/42; 364/469.01

[58] Field of Search ..... 226/4, 42; 364/471.01, 364/471.02, 471.03, 472.01, 469.01

[56] References Cited

U.S. PATENT DOCUMENTS

| | | | |
|---|---|---|---|
| 2,999,295 | 9/1961 | Manning et al. | 226/42 X |
| 3,610,496 | 10/1971 | Parker | 226/42 |
| 4,033,492 | 7/1977 | Imai | 226/42 X |
| 4,369,906 | 1/1983 | Isherwood | 226/4 X |
| 4,572,752 | 2/1986 | Jensen et al. | 226/27 X |
| 4,848,630 | 7/1989 | Niestrath et al. | 226/4 |
| 5,485,386 | 1/1996 | Andersson | 226/42 X |

FOREIGN PATENT DOCUMENTS

| | | |
|---|---|---|
| 1235955 | 3/1967 | Germany . |
| 1267928 | 5/1968 | Germany . |
| 2256882 | 12/1973 | Germany . |
| 31 43 545 | 5/1983 | Germany . |
| 37 34 427 | 4/1989 | Germany . |
| 2075074 | 11/1981 | United Kingdom . |

OTHER PUBLICATIONS

Patent Abstracts of Japan vol. 12 No. 160 (M–697), May 14, 1988 & JP,A,62 279057 (Kawasaki Steel Corp) Dec. 3, 1987.

Patent Abstracts of Japan vol. 7, No. 269 (M–259), Nov. 30, 1983 & JPA,A,58 148147 (Tokyo Shibaura Denki KK) Sep. 3, 1983.

Patent Abstracts of Japan vol. 16 No. 287 (M–1271), Jun. 25, 1992 & JP,A,04 075953 (Mitsubishi Heavy Ind Ltd) Mar. 10, 1992.

*Primary Examiner*—Michael Mansen

*Attorney, Agent, or Firm*—Michael D. Bednarek; Kilpatrick Stockton LLP

[57] ABSTRACT

A method for measuring and regulating the elongation of a moving material web that includes the steps of measuring the length change or speed change occurring over a drive roller, from which the elongation is calculated and, if it deviates from the desired elongation, the web tension is corrected in order to set the elongation. Such a method is preferably used in a web tension device disposed between a roll exchanger and a printing press. The web tension is preferably adjusted through the use of a dancer roller, whose force exerted on the material web is regulated by a controlled dancer cylinder.

20 Claims, 2 Drawing Sheets

METHOD FOR CALCULATING AND REGULATING THE ELONGATION OF A MOVING MATERIAL WEB, AND DEVICE FOR APPLYING THE METHOD

FIELD OF THE INVENTION

The invention relates to a method or calculating and regulating the elongation of a moving material web, in particular for application in a web tension regulating device disposed between a roll exchanger and the first printing unit of a printing press.

STATE OF THE ART

Such a method is known from WO-A-92/10419, in the case of which it is pointed out that this method is applied at a point between the printing rollers and the output rollers of a printing press.

The elongation of a material web which is subjected to certain processing operations must be kept essentially constant, in order to allow accurate positioning of the operations on the material web. For example, in a multicolour printing operation accurate positioning of the various printing units relative to the moving material web is essential for obtaining a uniform printing quality. It is known that the modulus of elasticity of a paper web on a stock roll is not constant, but changes, for example as the result of a varying moisture content. In the course of regulation of the material web to produce constant tension, as is also known in the art, with a changing modulus of elasticity the elongation $\epsilon$ will have to be adjusted in an inversely proportional manner, in order to keep the web tension $\sigma$ constant.

$(\sigma\text{-}E\ \epsilon)$

The known method comprises measuring a length change from a reference length of the material web, which change is caused by an imposed increase or decrease in the web tension, and measuring the web tension before and after the change in the web tension. This change in tension is imposed by means of an acceleration or deceleration roller, which is disposed downstream of the printing cylinders (viewed in the direction of movement of the material web). The elongation is calculated from the measured data, the length change and the web tension, based on the assumption that there is a linear correlation between the web tension and the elongation. If necessary, the web tension is then adjusted in order to maintain the elongation at the desired value. It is also disclosed that, instead of an additional acceleration or deceleration roller, the supply rollers, printing rollers or output rollers can be used to achieve the web tension change. However, this is not a preferred option, on account of the moment of inertia of such rollers.

A disadvantage of this known method is that the measurement procedure followed disrupts the movement of the material web, because a change in the web tension is essential for performing the measurement, which change is achieved by accelerating or decelerating the material web. Such a disruption of the movement of the material web can result in a disruption of the subsequent processing operations, for example a printing process. This disadvantage is partially overcome by carrying out the acceleration or deceleration of the material web after it has been printed. However, this has the disadvantage that a deviation from the desired elongation cannot be established and corrected until after printing of the web.

Another disadvantage is that if the modulus of elasticity E of the moving material web changes, said modulus must be determined again in order to permit calculation of the elongation.

A further disadvantage of this known method of regulation is that it is not possible to watch the elongation continuously, because the measurements are made at different times, before and after an imposed change in the web tension respectively.

SUMMARY OF THE INVENTION

The object of the present invention is to provide a continuous method for calculating and regulating an essentially constant elongation of a moving material web wherein a disruption of the movement of the material web is avoided.

Another object of the invention is to design the regulating method in such a way that variations in the web tension are filtered out, so that they barely affect the regulating method.

The method of the type described above according to the invention is characterized in that a length change or speed change of the material web is measured upstream and downstream of a drive roller, the elongation of the material web is calculated from the measured change and compared with a desired elongation and, if necessary, the web tension is corrected, in order to set the elongation at the desired value.

In the case of the method according to the invention, the unwound length per period of time or the speed per period of time is measured upstream and downstream of a drive roller. From these measured values the elongation can be calculated using the general formula: $\epsilon=(v_2-v_1)/v_2$ or $\epsilon=(1_2-1_1)/1_1$, where index 2 indicates the measuring position downstream of the drive roller, and index 1 indicates the measured position upstream of the drive roller. This calculated value of the elongation can be compared directly with the value of the desired elongation of the material web without measuring the web tension. Moreover, it is not essential to know the exact value of the modulus of elasticity in order to be able to carry out the regulation. The web tension can then be adjusted in order to correct the measured elongation to the desired value, if such a correction is necessary.

It has been found that the modulus of elasticity of a paper web from a stock roll often decreases while it is being unwound, i.e. the outer paper layers have a higher modulus of elasticity than the inner layers. In order to present such a material web to a processing operation with a constant elongation, the tension of the web will therefore have to be varied in a corresponding way. If the measured elongation of the material web is higher than the desired value, the web tension must be reduced. If the measured elongation is too low, the web tension must be increased.

The invention also relates to a device for conveying a material web with an essentially constant elongation, which is characterized in that the device comprises two measuring devices for measuring a length change or speed change of the moving material web, which devices are disposed upstream and downstream of a drive roller respectively, and a computing and regulating unit for calculating the elongation of the material web and emitting a signal for adjustment of the web tension of the material web, in order to set the elongation, and means for changing the web tension on the basis of this output signal.

Such a device, also called the infeed, is used to make an accurate adjustment of the characteristics of a material web coming from a stock roll in a roll exchanger or the like, and subsequently to present said material web to following processing devices.

BRIEF DESCRIPTION OF THE DRAWINGS

The invention will now be explained with reference to the drawing, in which.

DETAILED DESCRIPTION OF THE PREFERRED EMBODIMENTS

Figure 1:
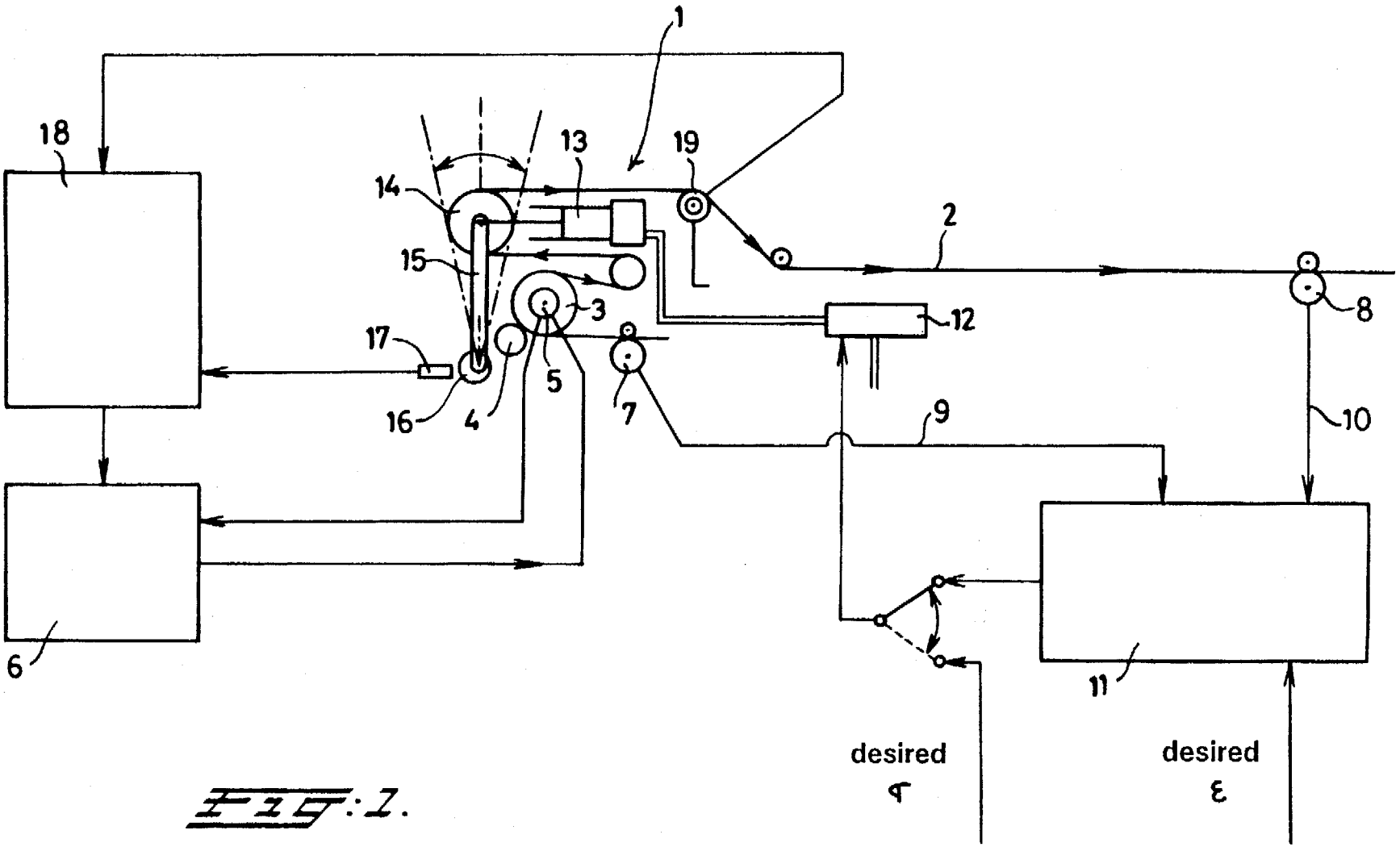
FIG. 1 is a diagrammatic illustration of a preferred embodiment of a device according to the invention.

In order to ensure that the regulating method according to the invention is not affected by rapid changes in the modulus of elasticity of the material web, the length change or speed change is preferably measured for certain intervals, and an average elongation is calculated from this measurement for said intervals. The influence of rapid changes in the modulus of elasticity is filtered out in this way. However, if a great change is expected, for example after the stock roll has been exchanged, the interval for which the elongation is calculated is preferably shortened, in order to be able to anticipate the changing modulus of elasticity more quickly.

Preferably the web tension is corrected initially by adjusting the force exerted on the material web without changing the speed of the drive roller. To this end, in a preferred embodiment of the method according to the invention, the pressure is adjusted in a dancer cylinder which sets the force exerted on the material web by a dancer roller disposed downstream of the drive roller. Such an embodiment makes it possible to filter out web tension variations.

Such a dancer roller is also advantageously held in a centre position by adjusting the speed of the drawing roller.

This embodiment of the method according to the invention in fact comprises a double regulation: a first regulation of the web tension, based on the measured and desired elongation, and subsequently a regulation of the speed of the drive roller, in order to produce the desired correction.

The regulating method according to the invention is preferably used in a web tension regulating device placed upstream of a printing press. This means that correction of the elongation is possible by adjusting the web tension prior to the printing operation itself.

In a preferred embodiment of the device according to the invention the means for adjusting the web tension are a dancer roller disposed between the drive roller and measuring device, and a dancer cylinder for correcting the force exerted on the material web by the dancer roller.

A regulating device for correcting the position of the dancer roller in the device according to the invention is preferably alto present, in order to prevent the dancer cylinder from filling up or emptying. This regulating device adjusts the speed of the drive roller.

FIG. 1 shows the so-called infeed 1, which is disposed between a roll exchanger and a printing press (neither of which is shown). A material web 2 is passed from the roll exchanger over a drawing roller 3 to the first printing station of a printing press, as indicated diagrammatically by arrows. A nip roller 4 ensures that the material web is pressed against the drawing roller 3. Said drawing roller 3 is provided with a motor 5, which is connected to a regulator 6, which controls the speed of the motor 5 and consequently that of the drawing roller 3. This speed control can be carried out on the basis of the current, voltage or frequency supplied to the motor. Disposed upstream and downstream of the drawing roller 3 are recorders 7 and 8, which measure the speed of the material web 2 upstream and downstream of the drawing roller 3. Said recorders 7, 8 pass on the measured values by way of lines 9 and 10 respectively to a computing and regulating unit 11 which calculates the elongation. The desired elongation, often a value determined by the user in practice, is stored in the regulating unit 11. A control signal for a transducer 12 is calculated by comparing the actual elongation and the desired elongation. The transducer 12 regulates the pressure in a dancer cylinder 13 of a dancer roller 14. The dancer roller 14 exerts a force on the material web 2, as a result of which the web tension is set. If the measured elongation is higher than the desired elongation, the pressure in the dancer cylinder 13 will be reduced, in order to lower the web tension, and vice versa. The dancer roller 14 is connected by means of an arm 15 to an eccentric 16. The dancer roller 14 is consequently movable through a certain angle, the position shown in the figure being a centre position. If the pressure in the cylinder 13 is changed in order to change the web tension of the material web 2, this takes the dancer roller 14 out of its centre position. This change of position of the dancer roller 14 is recorded by means of a measuring element 17 and passed on to regulating unit 18. In order to return the dancer roller 14 to its centre position, the current speed of the material web 2 measured with a press tachometer 19 and the measured position deviation are converted to a desired drive speed of the drawing roller 3 while maintaining the web tension at a constant value. The calculated value of the drive speed is passed on to the motor 5 by way of the motor regulator 6.

Figure 2:
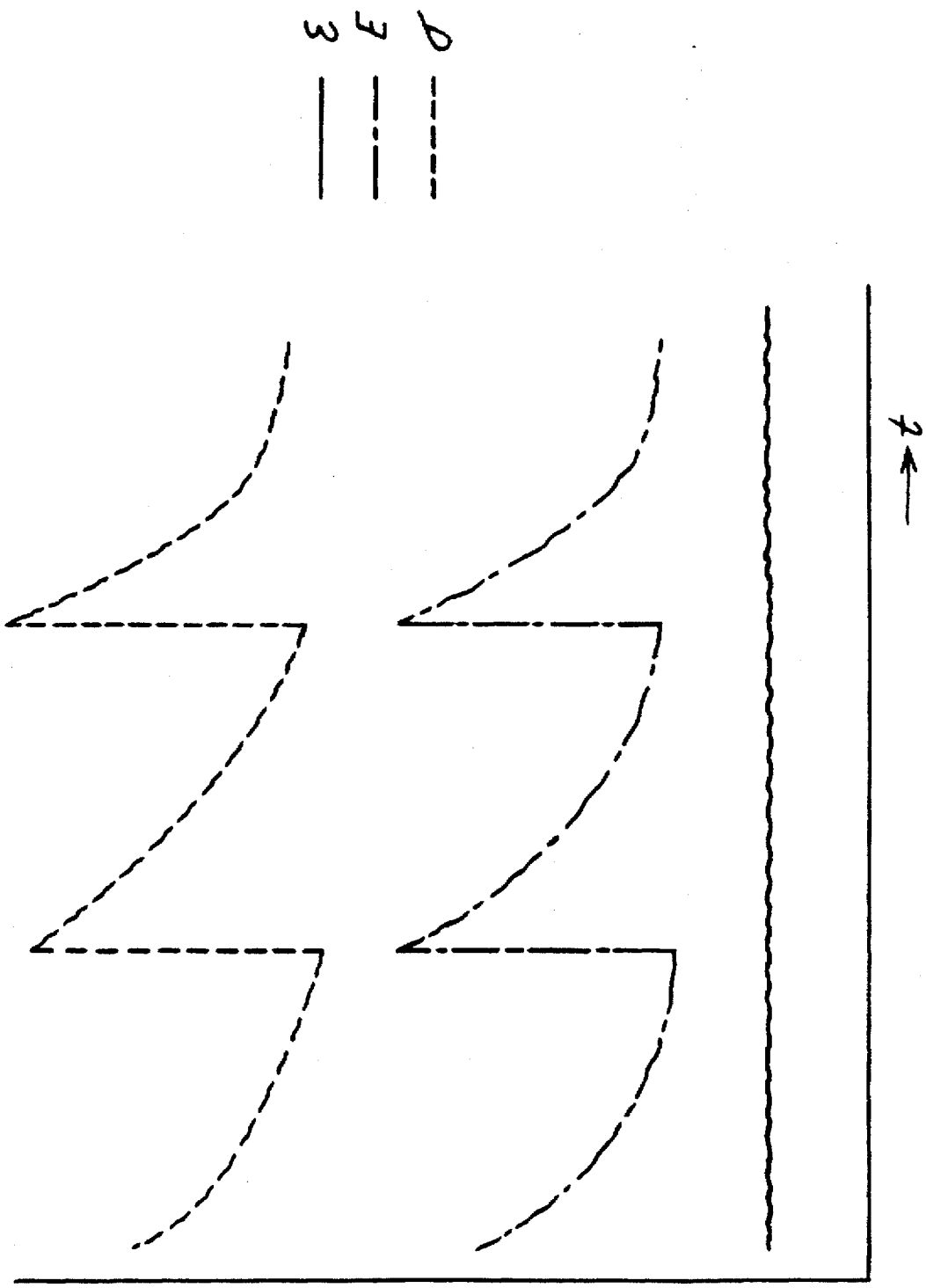
FIG. 2 is a graph of the elongation, web tension and modulus of elasticity as a function of time.

With this system the elongation added to the material web 2 by the drawing roller 3 is maintained at a constant value. This is illustrated further in FIG. 2, in which the curves of the elongation $\epsilon$, the modulus of elasticity E and the web tension $\sigma$ are plotted as a function of time t. The jumps in modulus of elasticity and the web tension $\sigma$ indicate, for example, a change-over from one stock roll to another. This shows the virtually constant value of the elongation which is obtained by a continuous adjustment of the web tension to the changing modulus of elasticity.

By integrating the measurements made by the recorders over the measuring periods, higher frequencies of disruption in the web tension or modulus of elasticity are filtered out without adverse effects on the regulation. This means that the high-frequency disruptions are filtered out, while the relatively slowly varying modulus of elasticity of the material web is followed accurately. In order to maintain the elongation of the material web at a constant value when there is a splice, the duration of the measuring periods can be shortened in the period around the splice.

Of course, it is also possible using the same dancer construction as that described above to measure the web tension difference over the drawing roller by measuring the web tension simultaneously both upstream and downstream of the drawing roller or measuring the couple on the motor of the drawing roller. The modulus of elasticity can be determined continuously in this way. The desired web tension which must be imposed on the paper web by the dancer, combined with the desired (set) elongation, can be calculated from this value.

As shown further in FIG. 1, the device can also be provided with a switch, in order to permit regulation at constant web tension. In that case the recorders 7 and 8 and the computing and regulating unit are put out of action. Instead of the control signal based on the elongation, a control signal based on the desired web tension is passed on to the transducer, following which the regulation of the web tension by means of the dancer construction is carried out in the manner described above.

What is claimed is:

1. In a web tension regulating device, a method for calculating and regulating the elongation of a moving material web that is driven by a drive roller, the method comprising the steps of:

applying a constant tensioning force on the material web downstream of the drive roller;

measuring an operating parameter of the moving material upstream of the drive roller, at discrete time intervals;

measuring the same operating parameter of the moving material web downstream of the drive roller at the same time intervals that the operating parameter is measured upstream of the drive roller;

determining the change in the operating parameter based on the measurements made upstream and downstream of the drive roller;

calculating the elongation of the material web based on the change in the operating parameters;

comparing the calculated elongation of the material web to a predetermined desired elongation value; and adjusting the constant tensioning force applied on the material web downstream of the drive roller based upon the comparison of the calculated elongation and the desired elongation to set the elongation at the desired elongation value.

2. The method of claim 1, wherein the operating parameter that is measured is the speed of the moving web.

3. The method of claim 1, wherein the operating parameter that is measured is the length of the material web per unit time.

4. The method of claim 1, wherein the operating parameter is measured continuously throughout each time interval and an average elongation for the interval is calculated from this measurement.

5. The method of claim 1, further comprising the step of shortening the predetermined time interval when an elongation change is expected.

6. The method of claim 1, further comprising the step of maintaining the speed of the drive roller constant while adjusting the constant tensioning force applied on the material web downstream of the drive roller.

7. The method of claim 6, wherein the constant tensioning force is applied to the material web by a dancer roller that is supported in a dancer cylinder that is adjustable from a center position to adjust the force applied by the dancer roller to the web.

8. The method of claim 7, further comprising the step of adjusting the speed of the drive roller to cause the dancer cylinder and dancer roller to be held in the center position.

9. A device for conveying a moving material web, the device comprising:

a drive roller for driving the moving material web;

an adjustable dancer roller for maintaining a selected tension on the material web downstream of the drive roller;

a first measuring device located upstream of the drive roller for measuring and emitting a signal indicative of an operating parameter of the moving material web at selected discrete time intervals;

a second measuring device located downstream of the drive roller for measuring and emitting a signal indicative of the same operating parameter of the moving material web downstream of the drive roller at selected time intervals;

a computing and regulating unit for receiving the signals emitted by the first and second measuring devices, calculating the elongation of the moving material web based on the signals and emitting an adjustment signal; and means for adjusting the selected tension that is maintained on the downstream side of the moving material web in response to the adjustment signal to obtain a predetermined elongation.

10. The device of claim 9, wherein the operating parameter that is measured is the speed of the moving web.

11. The device of claim 9, wherein the operating parameter that is measured is the length of the material web per unit time.

12. The device of claim 9, wherein the means for adjusting the web tension comprise a dancer roller disposed between the drive roller and the second measuring device and a dancer cylinder for adjusting the position of the dancer roller relative to the material web.

13. The device of claim 12, wherein the device also comprises a regulating device for adjusting the position of the dancer roller while maintaining a constant web tension.

14. The device of claim 13, wherein the regulating device adjusts the speed of the drive roller so as to adjust the position of the dancer roller while maintaining a constant web tension.

15. A device for conveying a moving material web, the device comprising:

a drive roller for driving the moving material web means for maintaining a selected tension on the material web downstream of the drive roller;

first measurement means located upstream of the drive roller for measuring and emitting a signal indicative of an operating parameter of the moving material web at selected discrete time intervals;

second measuring means located downstream of the drive roller for measuring and emitting a signal indicative of the same operating parameter of the moving material web downstream of the drive roller at selected time intervals;

means for receiving signals from the first and second measurement means and calculating the elongation of the moving material web based on the signals and emitting an adjustment signal; and means for adjusting the selected tension that is maintained on the downstream side of the moving material web in response to the adjustment signal to obtain a predetermined elongation.

16. The device of claim 15, wherein the operating parameter that is measured is the speed of the moving web.

17. The device of claim 15, wherein the operating parameter that is measured is the length of the material web per unit time.

18. The device of claim 15, wherein the means for adjusting the web tension comprise a dancer roller disposed between the drive roller and the second measuring device and a dancer cylinder for adjusting the position of the dancer roller relative to the material web.

19. The device of claim 18, wherein the device also comprises a regulating device for adjusting the position of the dancer roller while maintaining a constant web tension.

20. The device of claim 19, wherein the regulating device adjusts the speed of the drive roller so as to adjust the position of the dancer roller while maintaining a constant web tension.

* * * * *